US011642638B2

(12) United States Patent
Mills et al.

(10) Patent No.: US 11,642,638 B2
(45) Date of Patent: May 9, 2023

(54) PORTABLE PUMP FOR HIGH VISCOSITY MATERIALS

(71) Applicant: Hy-Flex Corporation, Knightstown, IN (US)

(72) Inventors: Allen Mills, Knightstown, IN (US); Collin Goodin, Knightstown, IN (US)

(73) Assignee: Hy-Flex Corporation, Knightstown, IN (US)

( * ) Notice: Subject to any disclaimer, the term of this patent is extended or adjusted under 35 U.S.C. 154(b) by 659 days.

(21) Appl. No.: 16/824,274

(22) Filed: Mar. 19, 2020

(65) Prior Publication Data

US 2020/0298193 A1 Sep. 24, 2020

Related U.S. Application Data

(60) Provisional application No. 62/822,105, filed on Mar. 22, 2019, provisional application No. 62/820,635, filed on Mar. 19, 2019.

(51) Int. Cl.

| | |
|---|---|
| ***B01F 35/00*** | (2022.01) |
| ***B01F 35/71*** | (2022.01) |
| ***B01F 35/32*** | (2022.01) |

(52) U.S. Cl.

CPC .. *B01F 35/717613* (2022.01); *B01F 35/3202* (2022.01); *B01F 35/3204* (2022.01); *B01F 35/71731* (2022.01); *B01F 35/3206* (2022.01)

(58) Field of Classification Search

CPC ..... B01F 35/717613; B01F 35/71731; B01F 35/3204

See application file for complete search history.

(56) References Cited

U.S. PATENT DOCUMENTS

| | | | | |
|---|---|---|---|---|
| 4,568,239 A * | 2/1986 | Sims | B65D 88/56 298/17.5 |
| 10,471,399 B1 * | 11/2019 | Hellbusch | B01F 35/71731 |
| 2012/0051982 A1 * | 3/2012 | Kois | B01F 35/10 422/261 |

* cited by examiner

*Primary Examiner* — Anshu Bhatia

(74) *Attorney, Agent, or Firm* — Overhauser Law Offices, LLC

(57) ABSTRACT

A pump for high viscosity materials is mounted on a rectangular frame that fits through a standard doorway. Quick detach latches allow removal of the grate, the hopper or the console, including the control box, from the frame for safer and lighter transportation of the pump. Extendable handles facilitate lifting, moving, and storing the pump. Pivotable wheels with locking mechanisms allows the pump to be moved in any direction by a single user.

17 Claims, 12 Drawing Sheets

PORTABLE PUMP FOR HIGH VISCOSITY MATERIALS

CROSS REFERENCE TO RELATED APPLICATIONS

This Application claims benefit of Provisional Application Ser. No. 62/820,635 filed Mar. 19, 2019 and Provisional Application Ser. No. 62/822,105 filed Mar. 22, 2019, the disclosures of which are incorporated herein in their entirety.

FIELD OF THE INVENTION

The present invention relates to pumps for high viscosity materials.

BACKGROUND

Being able to easily move a pump for high viscosity materials is important as they are frequently moved for use at different construction sites. Current pumps for high viscosity materials do not allow the pump to be easily or efficiently packed into trucks or trailers because of geometric protrusions, odd-shaped geometry, and lack of tie down points that address all loading positions.

The handles used on conventional pumps are designed to give the user the ability to push the machine, but are not adjustable and do not allow the machine to be positioned correctly for manual loading and carrying of the unit, which occurs frequently, especially at small job sites. This can lead to more on-site injuries as the unit's weight is not ergonomically distributed.

Current designs utilize a fixed axle in conjunction with one or two steering wheels or a fixed front support to maintain a low hopper loading height and a narrow width for easy access to doors and a minimal site footprint. This causes the unit to be able to be transported only in a single direction due to the fixed axle. On construction sites, the pump frequently needs to be moved in multiple directions to allow for disconnection from hoses and the cleanup of mixers. To accomplish this, the current units must be slid or lifted and moved in parallel directions to the fixed axle which is not easily accomplished due to the weight of the pump, contents of the hopper and typical site obstructions that make it difficult to utilize a forklift.

The lack of access to cranes, elevators, and forklifts on many jobsites make the current designs very difficult to move because they are large and heavy. They cannot be disassembled quickly, if at all, and cannot easily be made lighter for ease of carrying and moving.

Small pumps do not have forklift pockets or loops to secure the machine to the forklift when lifting because they are often bulky and get in the way of the operation of the machine. Because of this, small pumps are frequently dropped during lifting operations.

Current seals and mounting systems for pump motors or gearbox drives contain seal systems that either do not adequately protect and isolate the gearbox from failure or they isolate the gearbox from seal failure but add additional space and parts. Adding additional parts or making the pump system larger is not ideal as these pumps are often used on different construction sites in various stages of the build-out.

Pumps currently have a fixed guard or grate to protect the operator. This has traditionally been accomplished by bolting the guard in place. This creates problems due to the frequent cleaning required when pumping aggregate materials and can lead to unsafe operating conditions and Occupational Safety and Health Administration violations if the operator does not put the required bolts back in place.

SUMMARY OF THE INVENTION

One object of the present invention is to provide a pump for high viscosity materials that is capable of being easily disassembled and moved. By having a rectangular exterior design, the pump is flat on each side, which makes it easier to be packed in a truck or trailer, which are frequently used to transport the equipment. The rectangular, flat, surfaces allow the pump to mate against the transport surface, enhancing the pump's ability to be secured safely and easily with minimal effort.

Extendable handles allow the geometric protrusions to be exposed for operation and covered for transport by the rectangular exterior design, which is unavailable in current designs. The extendable handles also allow for easy attachment to loading straps and loops which provides the capability to efficiently tie the pump in place. Extendable handles can also solve the loading issues of the current design as the weight is able to be balanced and users can lift in a position that is ergonomically correct. This makes the unit able to be carried up steps or over uneven terrain by users in a safer manner.

The rectangular design of the frame allows for swivel wheels to be independently mounted on each corner inside the frame. This allows swivel wheels or pivotable wheels to be used without changing the outer physical dimensions of the pump. In addition, a locking device can be mounted on one or more of the swiveling wheels so that during transport one or more wheels can be locked to allow the pump to be easily steered by one person in a similar manner to a unit with a fixed axle.

DETAILED DESCRIPTION

Figure 1:
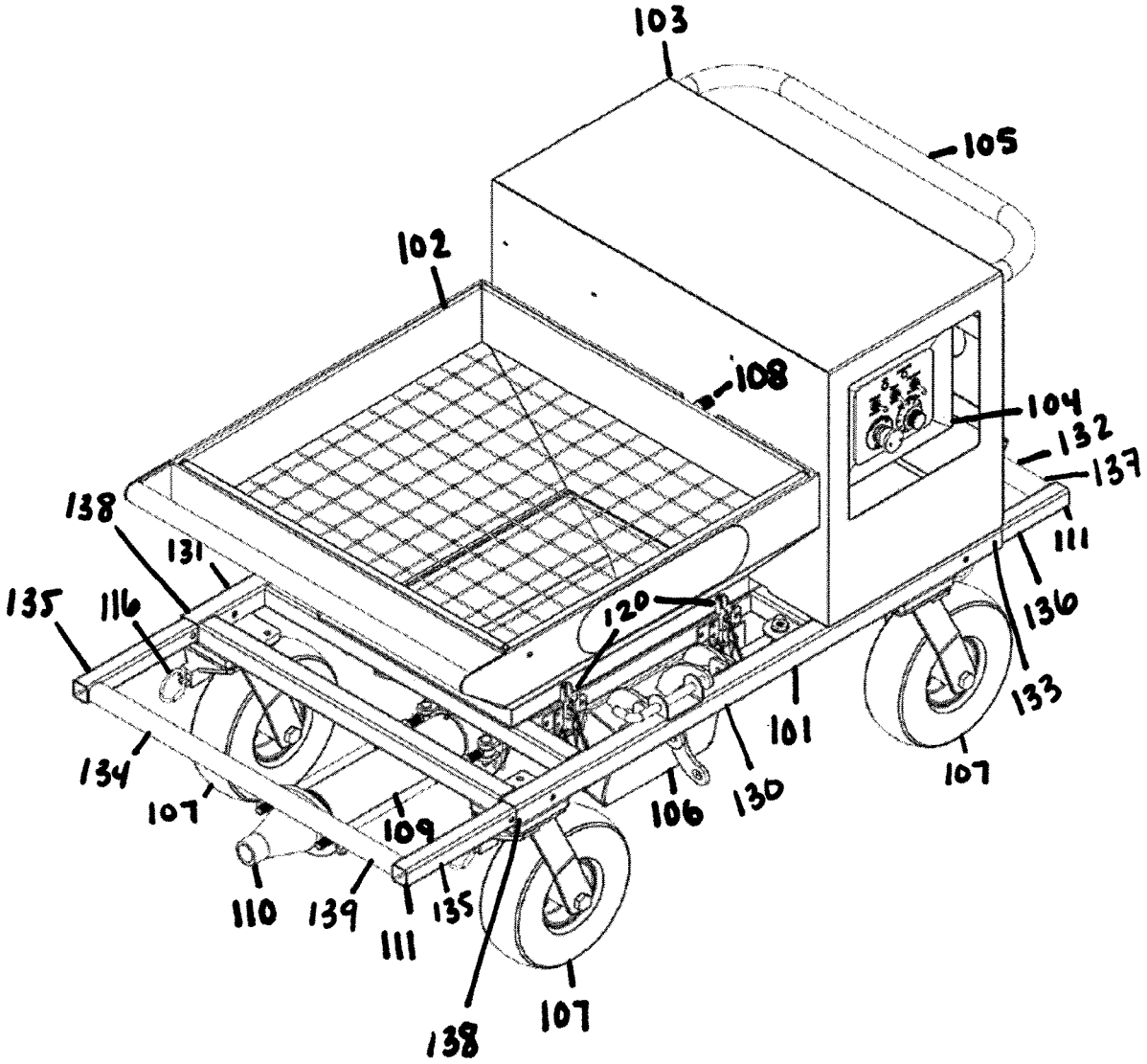
FIG. 1 shows an isometric view of the pump sitting on swivel wheels with various components of the present invention.
Figure 2:
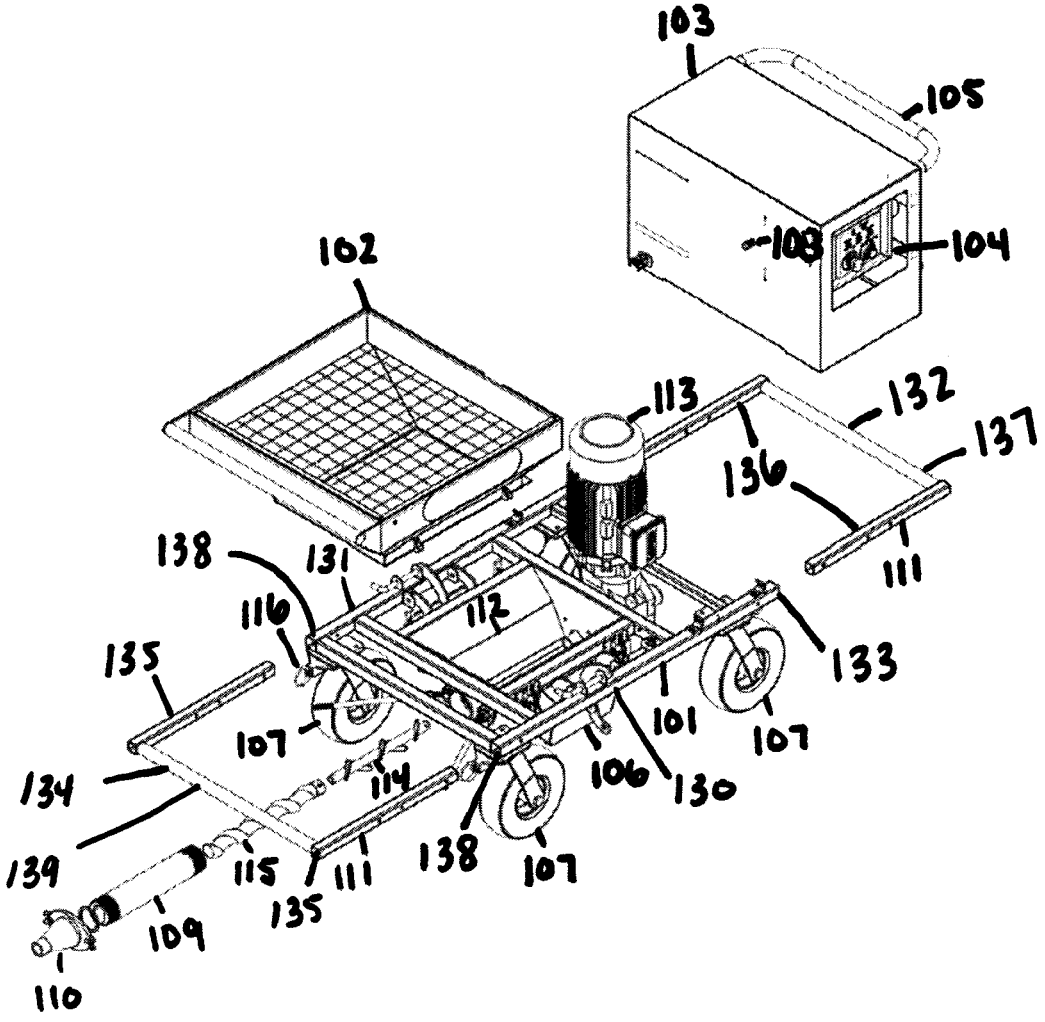
FIG. 2 shows an exploded view of the pump which demonstrates the detachability of the console, grate, and extendable handles.
Figure 3:
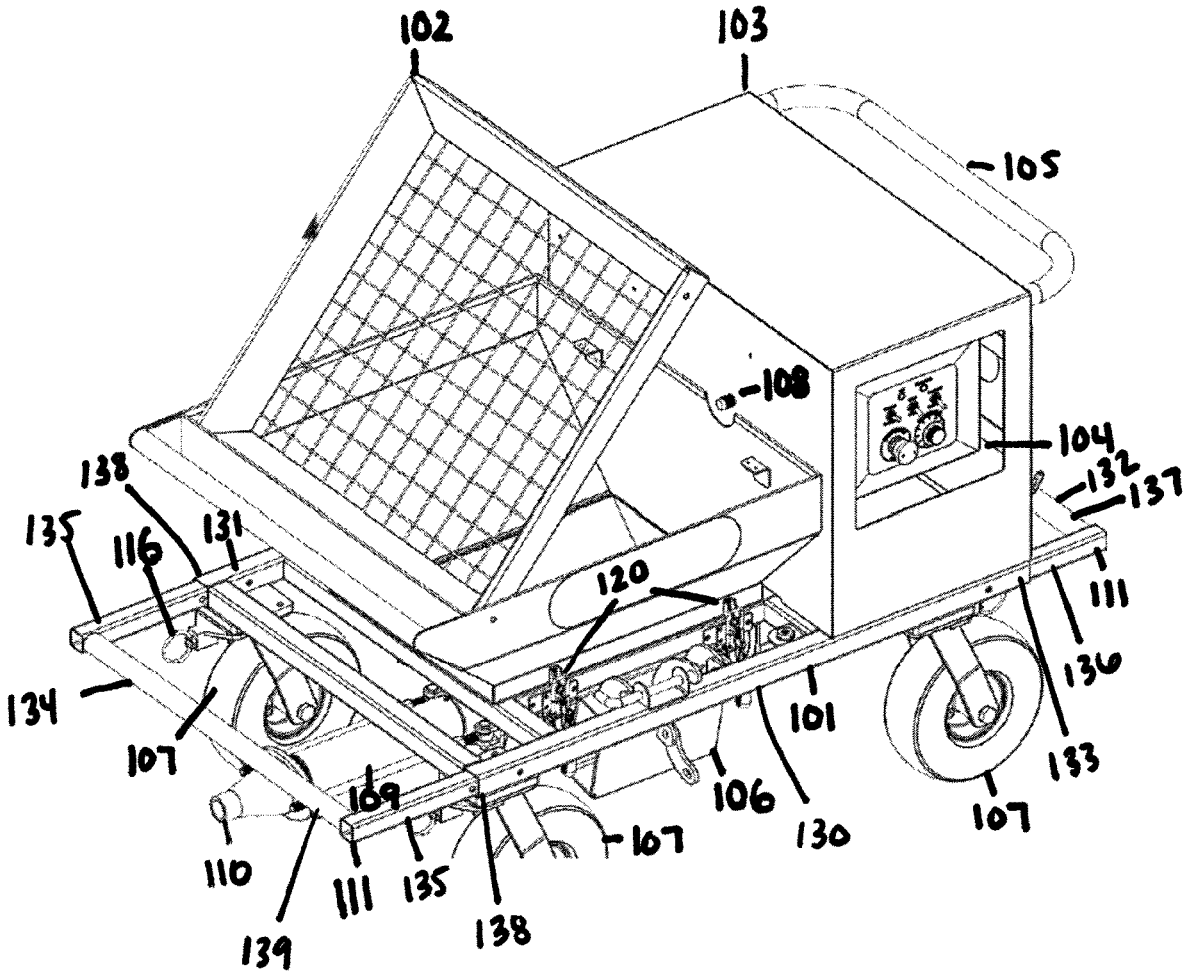
FIG. 3 shows an isometric view of the pump with the grate lifted and out of proximity to the sensor.

The present invention provides a pump for high viscosity materials as shown in one embodiment in FIG. 1. To utilize the embodiment of the present invention depicted in FIGS. 1 and 2, a person may fill the hopper 112 with a high viscosity material, such as fireproofing, plaster, cement or the like by pouring it through grate 102. Next, grate 102 should be placed in the closed position as shown in FIG. 1, in view of the proximity sensor 108 located on the console 103. The proximity sensor 108 acts as a safety kill switch and will not allow the pump to operate if the grate 102 is not in the proper position as shown in FIG. 3. A hose or sprayer can then be connected to the pump outlet 110. Then the pump can be turned on via a switch or button on the control panel 104.

Figure 4:
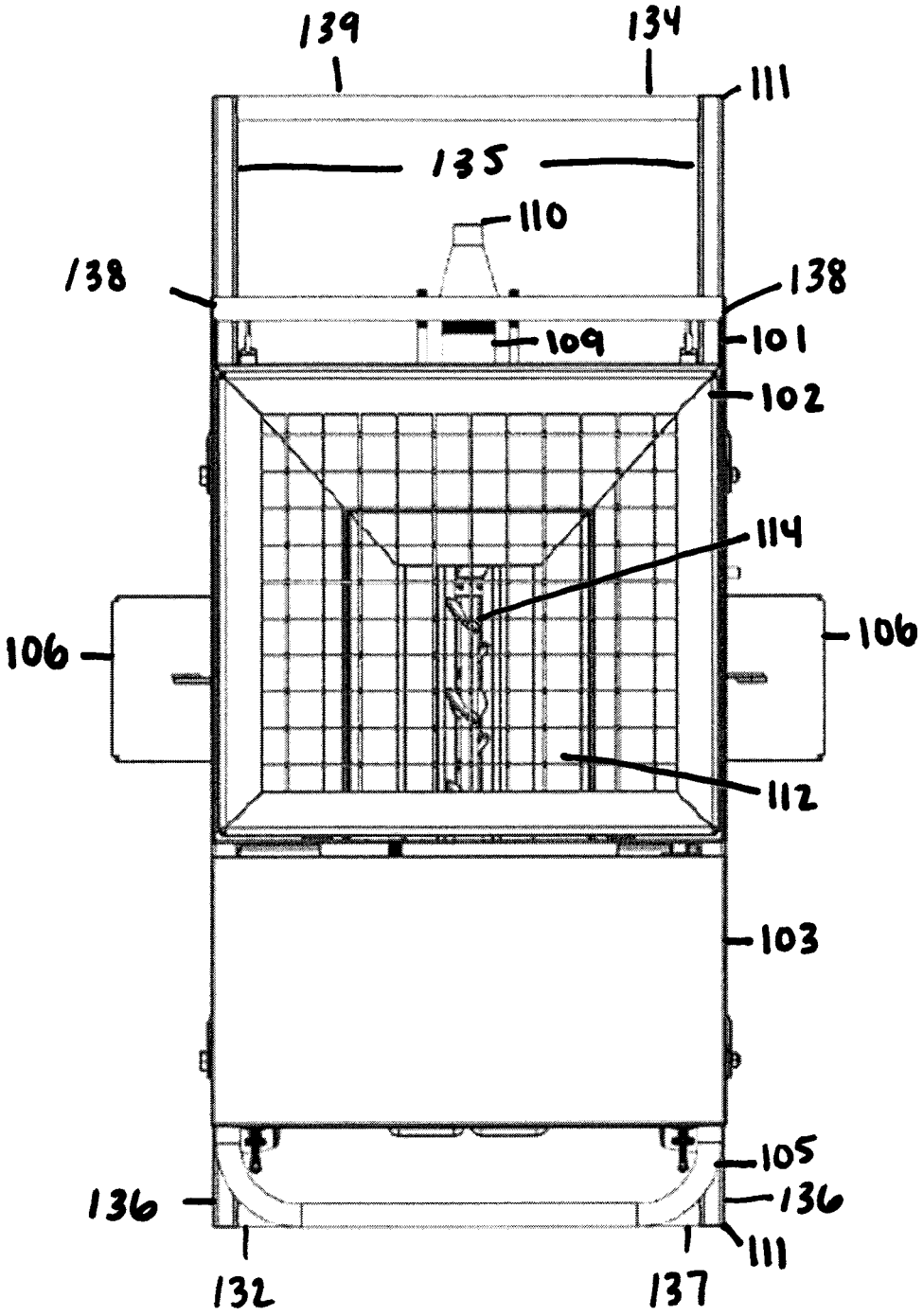
FIG. 4 shows an top view of the pump with the forklift pockets rotated to the in-use position.

Once the pump is turned on, the material moves down through the hopper 112 to a rotor/auger or connecting rod 114. The connecting rod 114 is connected to the gearbox motor 113 via the drive shaft 117 and bearingless seal unit 119 on one end and to the rotor 115 on the other end. The gearbox motor 113, via the drive shaft 117 and connecting rod 114, rotates the auger/rotor 115 and creates the pressure to push the material through the stator tube 109 and out of the pump outlet 110. While the embodiments as depicted in FIGS. 2 and 4 utilize a rotor 115 to assist in pumping the high viscosity material, the present invention is not limited to a rotary pump; a piston pump may be utilized pump the high viscosity material from the hopper. As is further evident from FIGS. 2 and 4, the frame has a width and depth which define a perimeter and hopper 112, motor 113 and pump are within the width and depth of frame 101.

Figure 5:
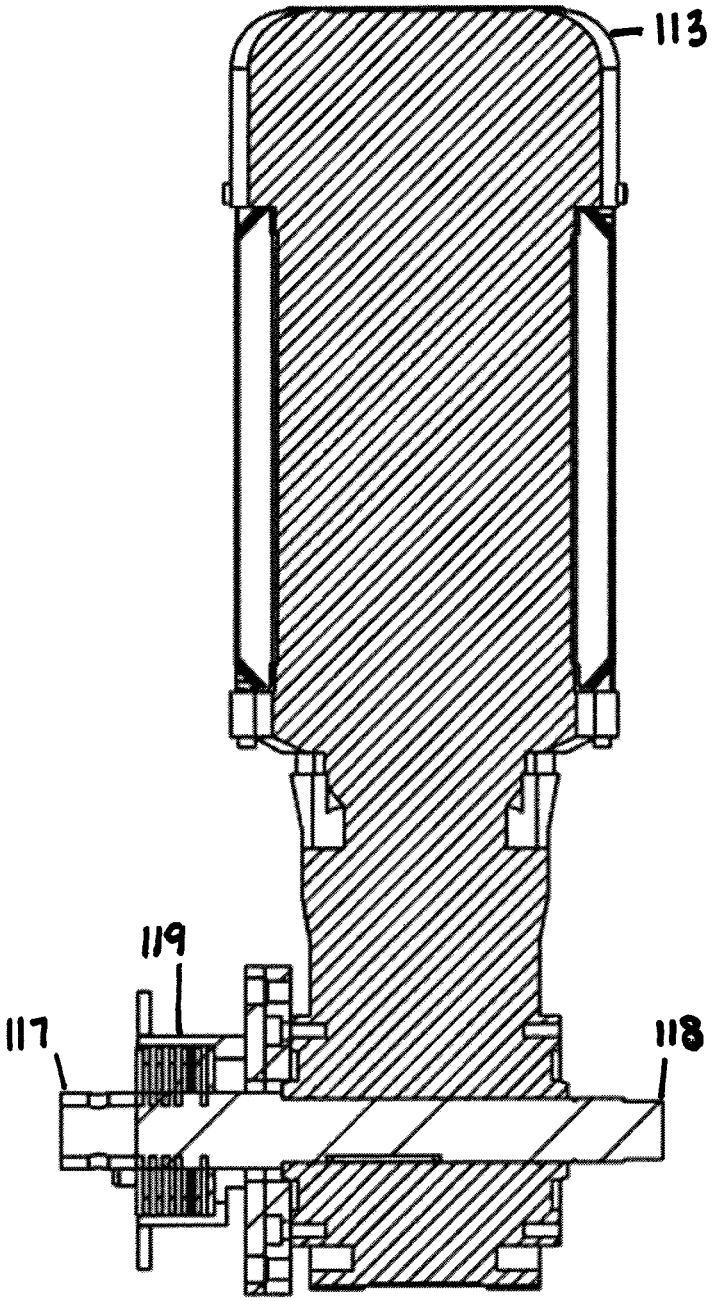
FIG. 5 shows a cross-section view of the gearbox motor, drive shaft, and bearingless seal unit.
Figure 6:
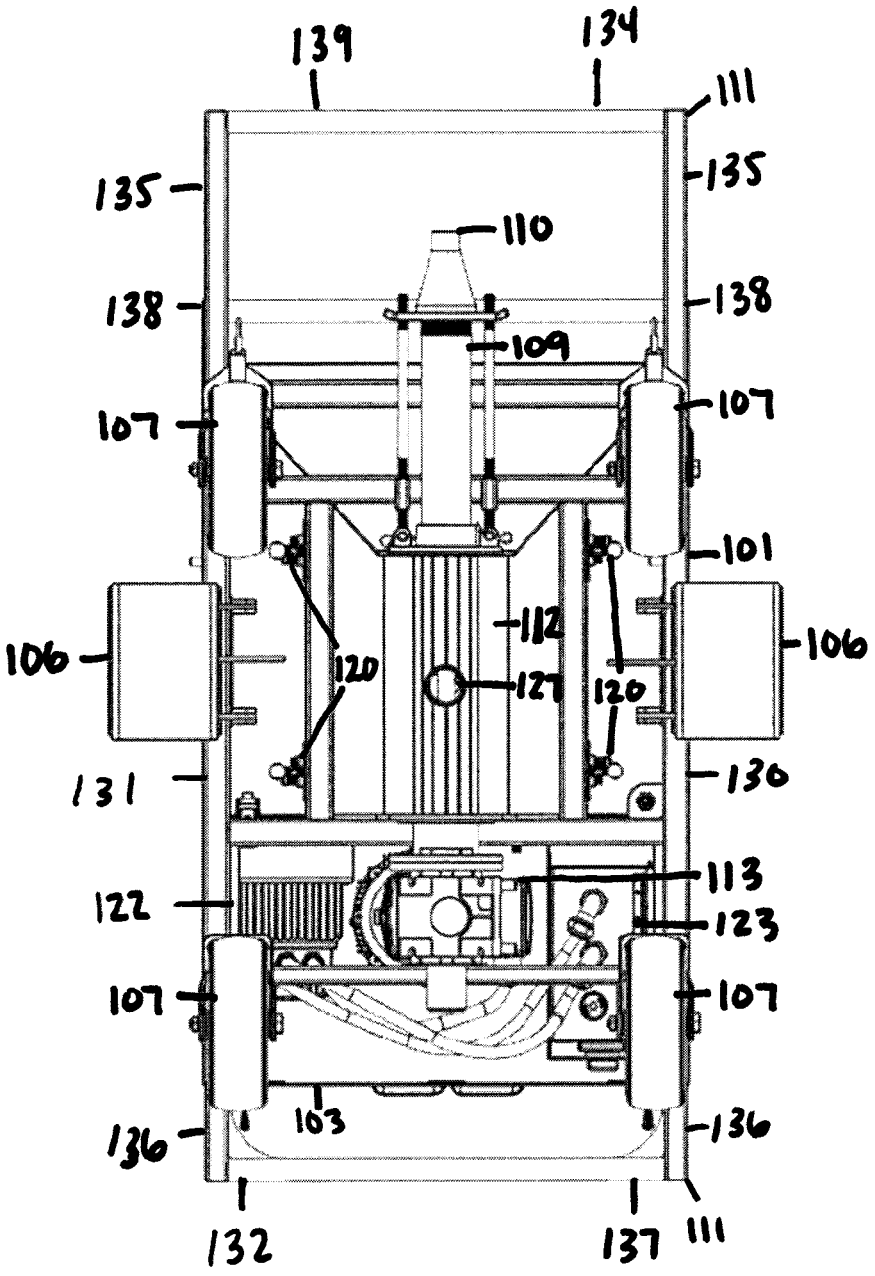
FIG. 6 shows a bottom view of the pump with the forklift pockets rotated to the in-use position.

The drive shaft 117 is driven by gearbox motor 113. Driveshaft 117 and it extends all the way through the bearingless seal unit 119 and the gearbox motor 113 and terminates with a hexagonal drive shaft end 118 opposite the connecting rod 114 as shown in FIG. 5. The motor has an axis of rotation that is perpendicular to drive shaft 117. Exposed hexagonal drive shaft end 118 allows the user to use a wrench to twist the drive shaft 117. This is helpful if the pump unit becomes stuck, because it is unnecessary to empty the hopper 112 via the hopper drain 127, as shown in FIG. 6. Instead, the hexagonal end of the drive shaft may be manually rotated to thereby rotate the auger.

As further shown in FIG. 2, a frame may comprise a first parallel frame member 130 and a second parallel frame member 131, each of which has a first end 133 and a second end 138. A first handle 132 and second handle 134 may each be comprised of parallel members 136 and 135, respectively, and a connecting member 137 and 139.

Figure 7:
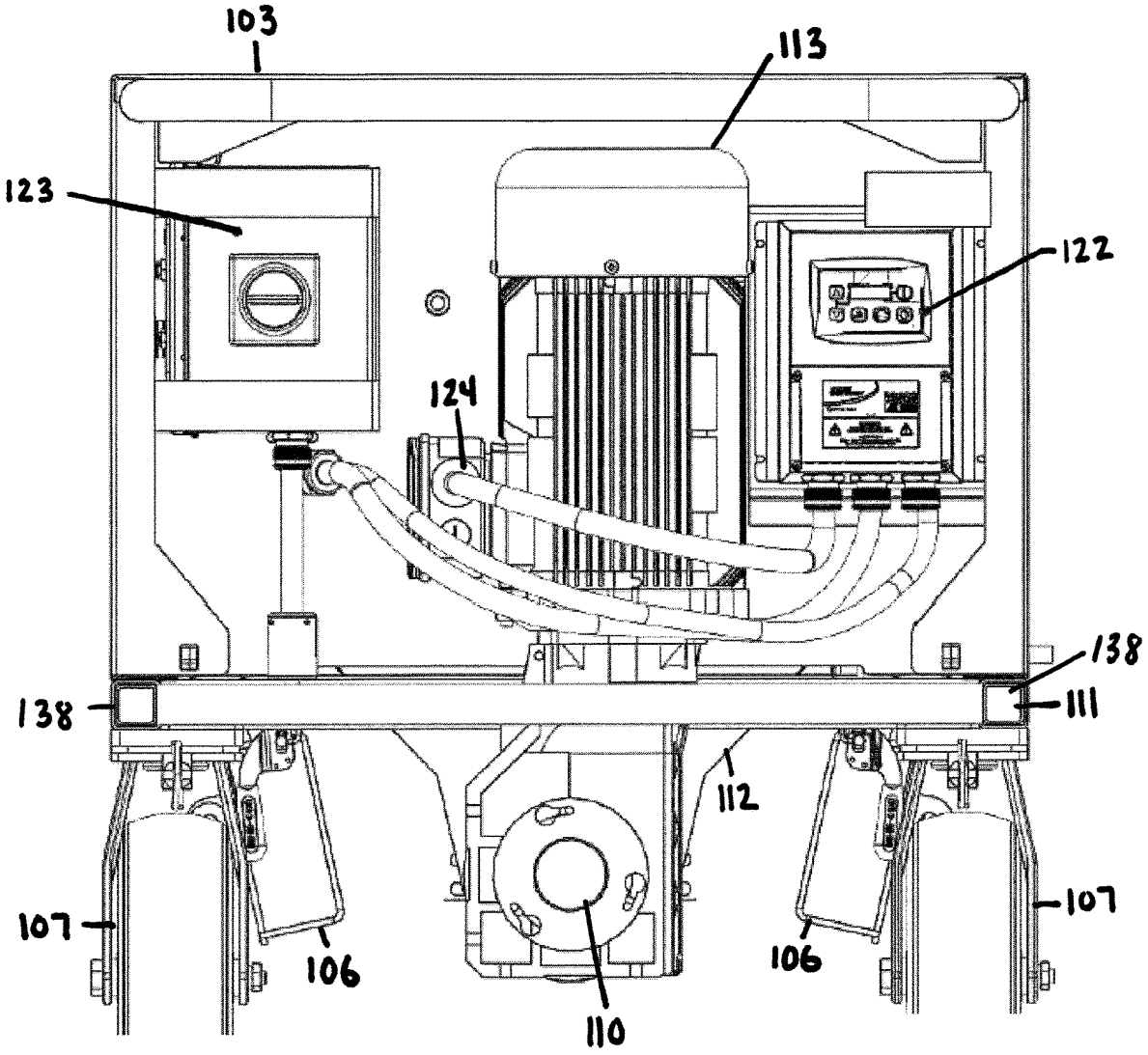
FIG. 7 shows a console for the pump, and an inverter drive, control box, and gearbox motor.
Figure 8:
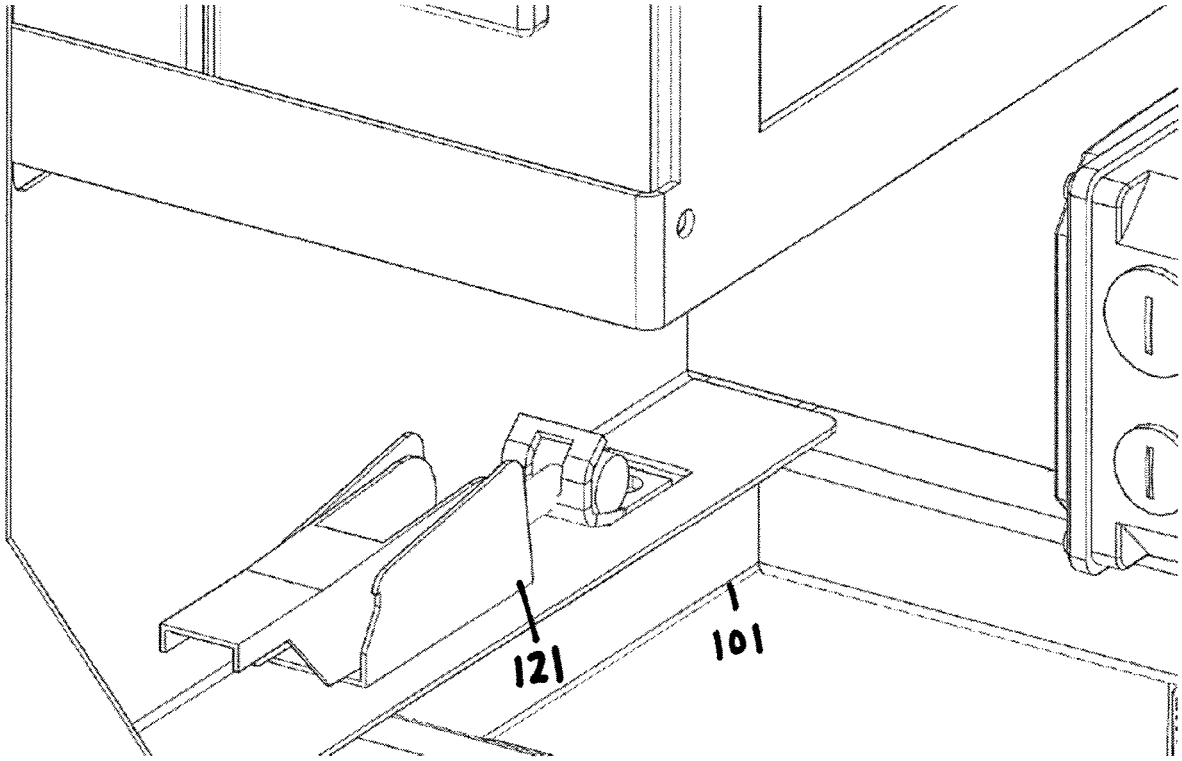
FIG. 8 shows a console quick detach latch to detach the console from the frame.

As shown in the embodiment in FIG. 7, control panel 104 is connected to control box 122 which is located within console 103. Control box 122 has a wire connected to the gearbox motor 113 with a twist electrical connector 124 for quick disconnection. While this embodiment shows a twist electrical connector 124, other quick disconnect connections may be used. The use of a quick disconnection from the control box 122 to the gearbox motor 113 and a console disconnect latch 121, as shown within console 103 in FIG. 8, allows for the console 103 to be removed quickly to reduce the weight of the pump for transport. Also located within the console 103, is the inverter drive 123 that converts the power for gearbox motor 113.

There are many embodiments of the present invention that contain different components that are used to assist with maneuvering the pump quickly and safely. For example, console 103 contains handle 105 that can be used to move the pump without having to bend down, alleviating safety concerns for the user's back. The swivel wheels 107 fit within the frame 101 so they do not add any extra width to the pump. In one embodiment, the width of the frame 101 is not more than 28 inches, which allows the pump to fit through many standard door frame. Swivel wheels 107 may be locked into various positions independent of the other swivel wheels 107 using a locking system which enables a single user to maneuver the pump with ease. While caster position locks 116 are shown in the embodiment of FIG. 9, other locking systems may be utilized.

Figure 9:
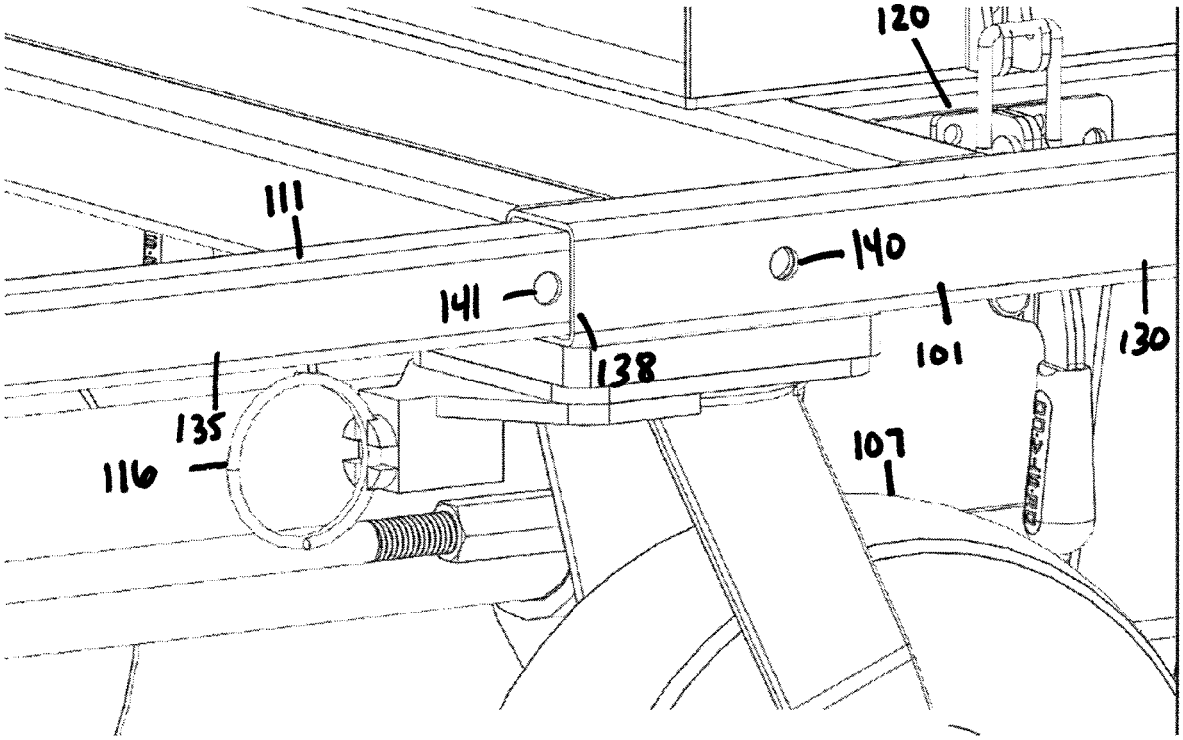
FIG. 9 shows a close up view of the caster lock mechanism for the swivel wheel and the quick detach latch to detach the grate and hopper from the frame.

Also as shown in FIG. 9, is the second end 138 of first parallel frame member 130, which may include hole 140. One of the parallel members of second handle 135, also has a plurality of holes, one of which is shown as 141. Aligning the holes on the parallel members of handles with the holes on the parallel frame members facilitates locking the extent to which the handles telescope within the side frame members. The locking may be accomplished by a variety of means well known in the art. For example, a depress button may be incorporated into the handles or frame to lock them to each other. Alternatively, a pin may be positioned to pass through the mating holes in the frame members and handle members.

Figure 10:
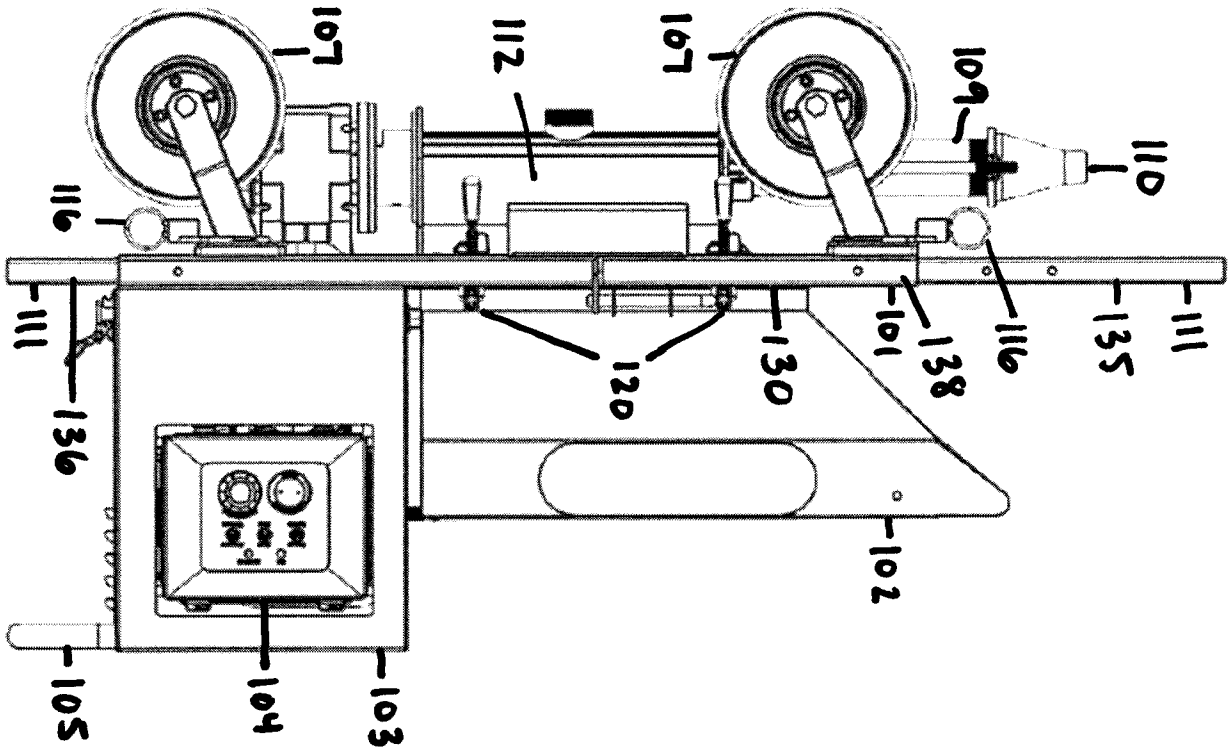
FIG. 10 shows a side view of the pump sitting on one extendable handle and a push handle for ease in cleaning and storage.
Figure 11:
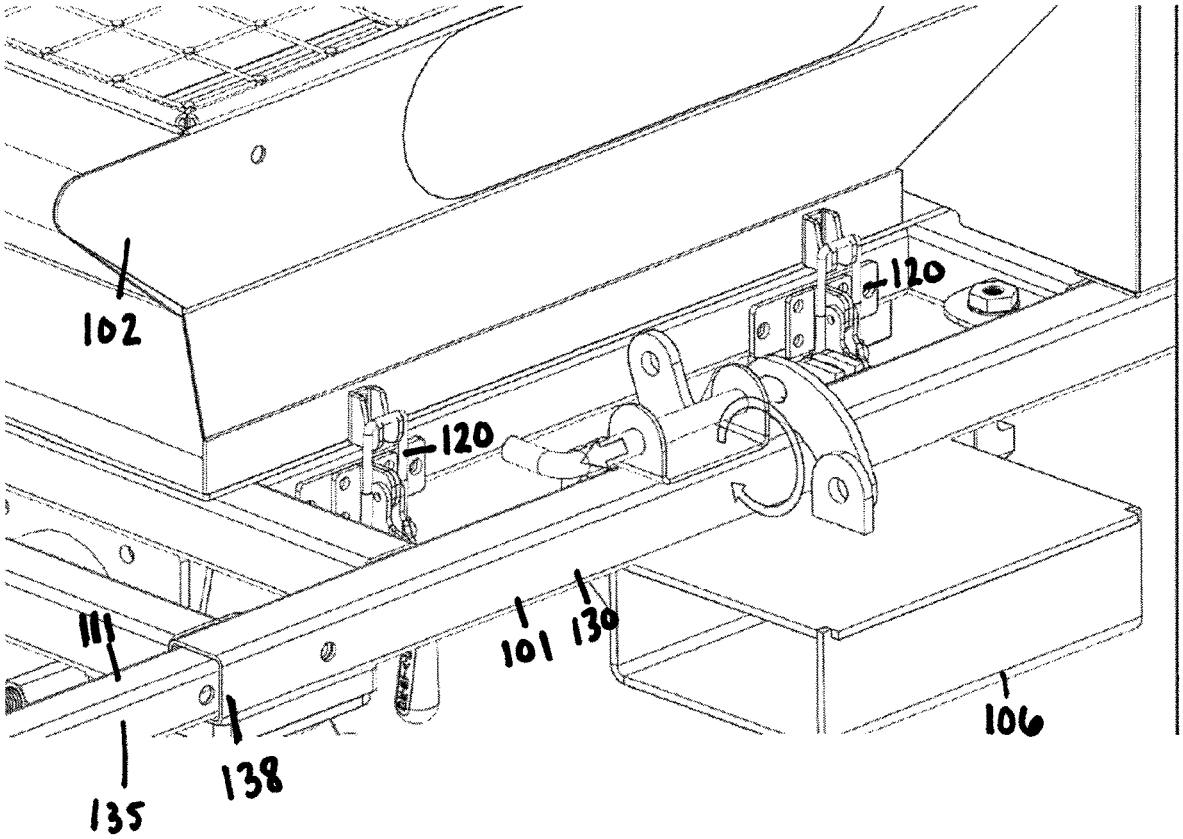
FIG. 11 shows a close up view of the forklift pocket rotated to the in-use position.

In addition, extendable handles 111 that fit within and telescope from frame 101 allow for increased ease in maneuverability. The extendable handles 111 allow for the pump to be lifted to more easily distribute the weight of the pump and allow the user to be ergonomically positioned for lifting and carrying the pump. Further, extendable handle 111, located just below the push handle, 105 can be locked into place to be even and/or coplanar with the push handle 105. In one embodiment, the push handle is connected to the frame via the console. This allows the pump to be placed on its side resting on the extendable handle 111 and the push handle 105 as depicted in FIG. 10 to allow for transport in a confined space such as an elevator, or for compact storage. Forklift pockets 106 can also be rotated from their stored position within the frame 101 to their in-use position outside of the frame 101, as in FIGS. 4, 6, and 11, to allow the pump to be safely lifted or moved by a forklift.

Figure 12:
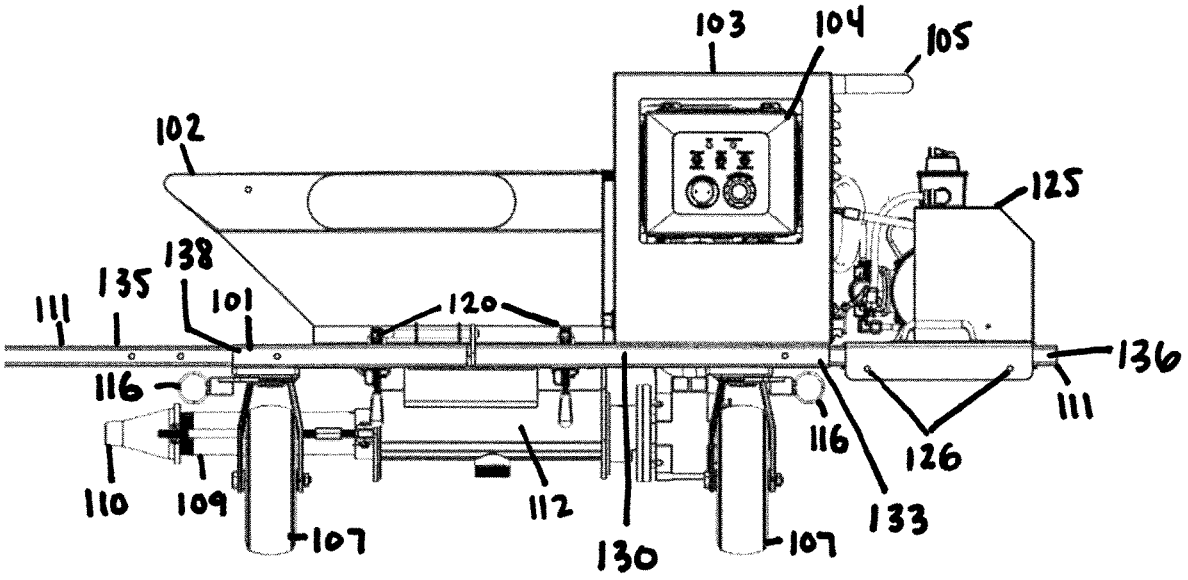
FIG. 12 shows a side view of the pump with an auxiliary air compressor attached to one of the extendable handles.

Console 103 is removable from the frame 101 via console disconnect latches 121. Grate 102 is likewise removable from the hopper 112 via grate disconnect latches 120. Removing console 103 and grate 102 greatly decreases the weight of the pump for transport and allows for easy cleaning and maintenance. Additionally, extendable arms 111 can be used to hold auxiliary components such as an air compressor 125 as shown in FIG. 12. The air compressor 125 is secured to a platform with recesses to fit over the extendable arms 111. The platform then holes 126 in which pin locks, detent locks or other types of locks may be used to secure the platform to extendable arms 111.

While the invention has been illustrated and described in detail in the foregoing drawings and description, the same is to be considered as illustrative and not restrictive in character, it being understood that only illustrative embodiments thereof have been shown and described and that all changes and modifications that are within the scope of the following claims are desired to be protected.

All references cited in this specification are incorporated herein by reference to the extent that they supplement, explain, provide a background for, or teach methodology or techniques employed herein.

What is claimed is:

1. A pump for high-viscosity materials comprising:

a frame;

a hopper for holding high-viscosity materials mounted to the frame;

the hopper having an outlet;

an electrically powered motor connected to the frame;

a high viscosity pump connected to the frame and the hopper outlet;

the high viscosity pump having a pump outlet;

a control system controlling the motor;

a grate covering the hopper and having apertures therein to permit high viscosity material to flow into the hopper through the apertures;

latches for detachably mounting the hopper to the frame;

a console holding the control system;

latches for detachably mounting the console to the frame;

an electrical connection between the control system and the motor; and a twist connector between the control system and the motor, such that the console may be detached and removed from the frame by unfastening the latches connecting the console to the frame and disconnecting the twist connector between the control system and the motor, and lifting the console including the control system from the frame.

2. The pump for high-viscosity materials of claim 1, further comprising:

a kill switch operable to detect the presence of the grate on the hopper and to prevent the motor from operating if the grate is not present.

3. The pump for high-viscosity materials of claim 2, wherein:

the kill switch is mounted on a console.

4. The pump for high-viscosity materials of claim 1, wherein:

the console covers the motor when the console is mounted to the frame.

5. The pump for high-viscosity materials of claim 1, further comprising:

a grate covering the hopper and having apertures therein to permit high viscosity material to flow into the hopper through the apertures; and latches for detachably mounting the hopper to the frame.

6. A pump for high-viscosity materials comprising:

a frame, wherein:

the frame includes first and second parallel frame members, each such frame member having first and second ends, and further comprising:

a first handle extendable from the first ends of the frame members, the first handle comprising two parallel members and a connecting member; and a second handle extendable from the second ends of the frame members, the second handle comprising two parallel members and a connecting member;

a hopper for holding high-viscosity materials mounted to the frame;

the hopper having an outlet;

a motor connected to the frame;

a high viscosity pump connected to the frame and the hopper outlet;

the high viscosity pump having a pump outlet; and a control system controlling the motor.

7. The pump for high-viscosity materials of claim 6, wherein:

the first handle and the second handle each fit within and telescope from the first and second parallel frame members.

8. The pump for high-viscosity materials of claim 7, further comprising:

locks fixing the extent to which the first handle and the second handle telescope within the side frame members.

9. The pump for high-viscosity materials of claim 1 wherein:

the frame is rectangular; and the width of the frame is no more than 28 inches.

10. A pump for high-viscosity materials comprising:

a frame, wherein:

the frame includes first and second parallel frame members, each such frame member having first and second ends, and further comprising:

a first handle extendable from the first ends of the frame members, the first handle comprising two parallel members and a connecting member;

and wherein:

the first handle is extendable from the first ends of the parallel frame members; and further comprising locks fixing the extent to which the first handle extends from the first and second parallel frame members;

a hopper for holding high-viscosity materials mounted to the frame;

the hopper having an outlet;

a motor connected to the frame;

a high viscosity pump connected to the frame and the hopper outlet;

the high viscosity pump having a pump outlet;

a control system controlling the motor;

a push handle connected to the frame;

wherein:

the first handle is locked into position to be coplanar with the push handle.

11. A pump for high-viscosity materials comprising:

a frame;

a hopper for holding high-viscosity materials mounted to the frame;

the hopper having an outlet;

a motor connected to the frame;

a high viscosity pump connected to the frame and the hopper outlet;

the high viscosity pump having a pump outlet;

a control system controlling the motor;

pivotable wheels; and locks to prevent the pivotable wheels from pivoting.

12. The pump for high-viscosity materials of claim 1:

wherein a frame has a width and depth, and the hopper, motor and pump are within the width and depth of the frame.

13. A pump for high-viscosity materials comprising:

a frame having an outer perimeter;

a hopper for holding high-viscosity materials mounted to the frame;

the hopper having an outlet;

a motor connected to the frame;

a high viscosity pump connected to the frame and the hopper outlet;

the high viscosity pump having a pump outlet;

a control system controlling the motor;

lift pockets movably connected to the frame that are able to receive forks of a forklift, wherein:

the lift pockets are movable between a first position in which the lift pockets do not extend outside the perimeter of the frame; and a second position in which the lift pockets extend outside the perimeter of the frame.

14. A pump for high-viscosity materials comprising:

a frame;

a hopper for holding high-viscosity materials mounted to the frame;

the hopper having an outlet;

a motor connected to the frame;

a high viscosity pump connected to the frame and the hopper outlet, the pump comprising an auger;

the high viscosity pump having a pump outlet;

a control system controlling the motor;

a gearbox having opposing sides, both opposing sides adapted to receive a drive shaft extending beyond the opposing sides;

a drive shaft driven by the gearbox comprising:

a first end connectible to the auger; and a second hexagonal end, such that the hexagonal end of the drive shaft may be manually rotated to thereby rotate the auger.

15. The pump for high-viscosity materials of claim 14 wherein the motor has an axis of rotation that is perpendicular to the drive shaft.

16. A pump for high-viscosity materials comprising:

a frame;

a hopper for holding high-viscosity materials mounted to the frame;

the hopper having an outlet;

a motor connected to the frame;

a high viscosity pump connected to the frame and the hopper outlet;

the high viscosity pump having a pump outlet;

a control system controlling the motor;

a grate covering the hopper and having apertures therein to permit high viscosity material to flow into the hopper through the apertures;

latches for detachably mounting the hopper to the frame; and a kill switch operable to detect the presence of the grate on the hopper and to prevent the motor from operating if the grate is not present.

17. The pump for high-viscosity materials of claim 16 wherein:

the kill switch is mounted on a console.

* * * * *